United States Patent [19]

Bains

[11] 4,309,933

[45] Jan. 12, 1982

[54] EXTERNALLY POWERED GUN LOADING AND EJECTION SYSTEM

[75] Inventor: William R. Bains, Lake Elsinore, Calif.

[73] Assignee: Ford Motor Company, Dearborn, Mich.

[21] Appl. No.: 47,402

[22] Filed: Jun. 11, 1979

[51] Int. Cl.[3] ..... F41D 7/02; F41D 9/02

[52] U.S. Cl. ..... 89/9; 89/24; 89/33 MC; 89/33 F

[58] Field of Search ..... 89/9, 11, 24, 17, 33 MC, 89/33 F, 33 BA; 42/39.5

[56] References Cited

U.S. PATENT DOCUMENTS

| | | | |
|---|---|---|---|
| 225,461 | 3/1880 | Coloney | 89/24 |
| 282,553 | 8/1883 | McLean | 89/33 MC |
| 2,522,457 | 9/1950 | Martin | 89/33 BC |
| 2,528,945 | 11/1950 | Carpenter | 89/33 BAX |
| 2,646,722 | 7/1953 | Eastman | 89/33 F |
| 2,725,791 | 12/1955 | Grovenhorst et al. | 89/33 D |
| 2,856,819 | 10/1958 | Meyers et al. | 89/33 MC X |
| 2,950,652 | 8/1960 | O'Brien | 89/155 |
| 2,965,006 | 12/1960 | O'Brien | 89/155 |
| 2,973,692 | 3/1961 | Altschuler | 89/33 |
| 2,977,854 | 4/1961 | Wassel et al. | 89/13 |
| 2,977,856 | 4/1961 | Fletcher | 89/33 |
| 2,998,758 | 9/1961 | Ovellette | 89/155 |
| 3,296,930 | 1/1967 | Rocha | 89/33 |
| 3,667,147 | 6/1972 | Golden | 89/33 MC X |

FOREIGN PATENT DOCUMENTS

| | | |
|---|---|---|
| 85016 | 5/1895 | Fed. Rep. of Germany . |
| 1960023 | 4/1977 | Fed. Rep. of Germany . |
| 577338 | 5/1946 | United Kingdom . |

*Primary Examiner*—David H. Brown

*Attorney, Agent, or Firm*—Steven L. Permut; Clifford L. Sadler

[57] ABSTRACT

An externally powered twin-barrel shuttle gun which has a shuttle having two firing chambers. The shuttle linearly moves between two positions so that the firing chambers are alternately fed a round of ammunition and discharged. The feed system has a pair of augers, each with a helical groove therein which receives a round of ammunition which obtains a dwell position on the zero pitched section of the grooves. A ramming system rams a round of ammunition to the firing chamber aligned therewith and simultaneously ejects any spent cartridge through a forward aperture in the housing. The spent cartridge is frictionally engaged by an axially aligned acceleration belt which quickly withdraws the spent cartridge from the firing chamber and accelerates it onto a deflection cam.

11 Claims, 4 Drawing Figures

EXTERNALLY POWERED GUN LOADING AND EJECTION SYSTEM

BACKGROUND OF THE INVENTION

1. Field of the Invention

This invention relates to an externally powered gun having multiple number of fixed barrels.

2. Description of the Prior Art

Advances in rapid fire guns have produced guns capable of firing over three thousand rounds per minute. With such capabilities, it is extremely important to have a feed system which moves the rounds of ammunition to the firing chamber in line with the barrel with the minimum amount of movement and to have dwell positions which are accurately controlled so that ammunition can be transfered from the feed system to the firing chamber and then out through the barrel.

U.S. Pat. No. 3,667,147 issued to Goldin et al. on June 6, 1972 discloses a self-powered gun which has a breech block which vertically moves between a position aligned with the magazine and an upward position wherein it is aligned with the barrel and forms the firing chamber. The breech block has a follower cam engaging a slot within a cam plate which reciprocally moves such that the breech block has two dwell positions in alignment with the aforementioned magazine and barrel.

U.S. Pat. No. 2,977,854 issued to Wasset et al. on Apr. 4, 1961 discloses a rotating sprocket which moves the ammunition in alignment with the barrel. A shuttle moves toward the sprocket such that the sprocket and the shuttle form a split firing chamber.

U.S. Pat. No. 2,973,692 issued to Altschuler on Mar. 7, 1961 discloses a single shuttle twin barrel gun in which a shuttle linearly moves between two positions between two rotating sprockets. Again the shuttle and sprockets form a split firing chamber.

Twin barrel guns using split firing chambers present problems in the fact that extreme stresses occur in the firing chamber which can cause premature wear on the gun parts particularly to the sprocket and shuttle which form the split chamber.

SUMMARY OF THE DISCLOSURE

In accordance with the invention, a multi-barrel machine gun has an external motor which drives a gearing mechanism that is operably mounted on a housing. The gearing mechanism operably drives a feed system which drives ammunition to the firing chambers.

In one embodiment, the firing chambers comprise parallel and spaced bores formed in a shuttle which is linearly moveable between two positions in which the first position has one bore aligned with the feed system and a second bore aligned with one of the barrels and a second position in which the second bore is aligned with the feed system and the first bore is aligned with the second barrel.

Further, according to the invention, the housing has a forwardly positioned ejection hole therethrough which is aligned with the bore that is in alignment with the feed system. A belt is mounted in front of the ejection hole and is operably connected to the motor for forwardly moving such that upon the startup of the gun the belt frictionally grasps may ejecting cartridges from the ejecting hole and axially accelerates them out of the ejection hole.

Further, according to the invention, the feed system includes a pair of augers rotatably mounted about parallel axis transverse to the general longitudinal axis of the barrels. Each auger has a helical groove therein with the end of each groove forming a zero pitched grooved ring. The augers are operably connected to the gearing means for continuous and simultaneous rotation such that portions of the grooves are longitudinally aligned to receive a round of ammunition and maintaining the round of ammunition in a longitudinal position as the augers rotate.

BRIEF DESCRIPTION OF THE DRAWINGS

Reference now will be made to the following drawings in which:

FIG. 3 is another partially broken and fragmentary view of the embodiment shown in FIG. 1.

DETAILED DESCRIPTION OF THE PREFERRED EMBODIMENT

Figure 1:
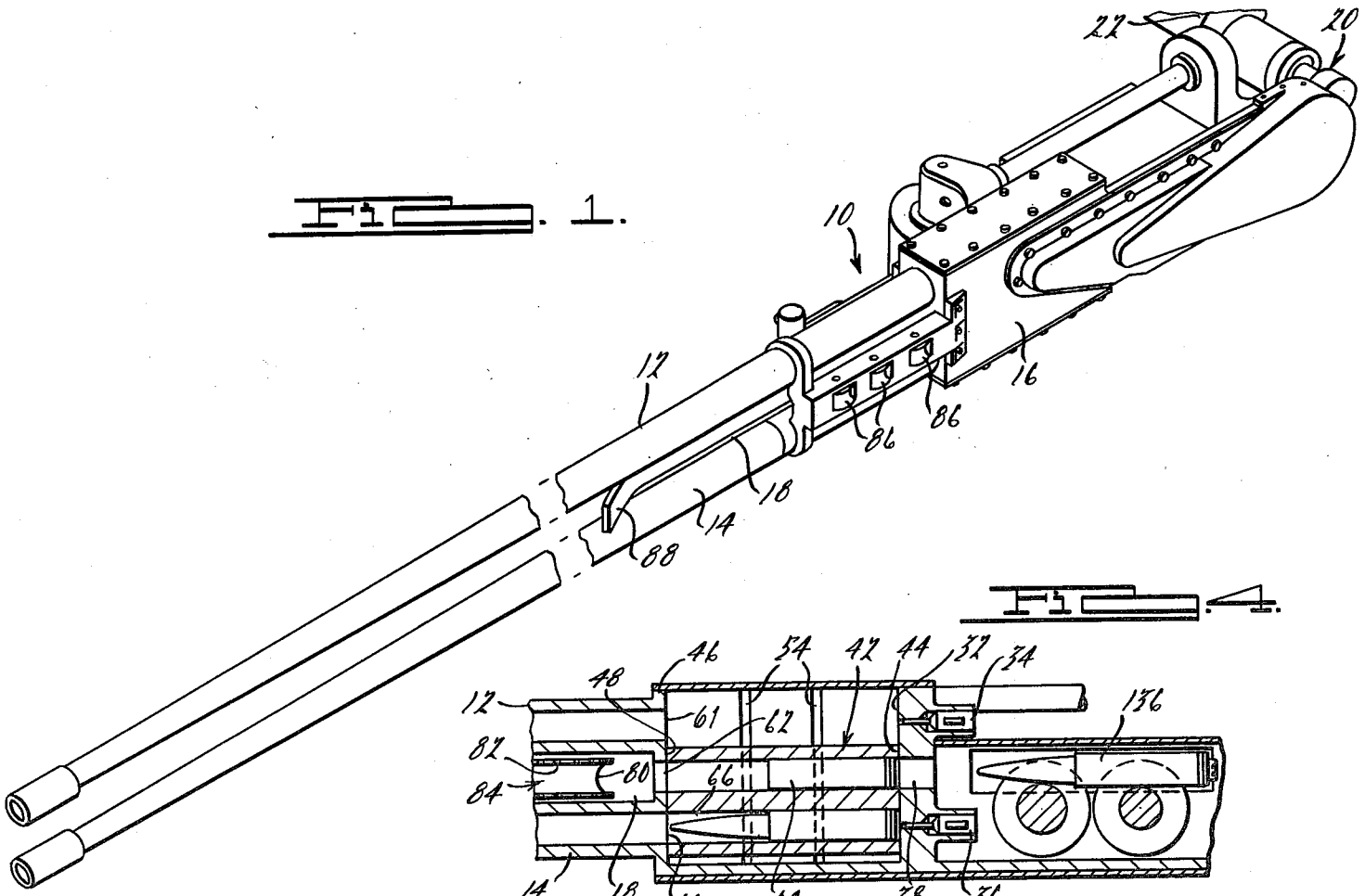
FIG. 1 is a front perspective view of one embodiment of the invention.

Referring now to the figures, particularly FIG. 1, a machine gun 10 has two vertically spaced barrels 12 and 14 mounted to a housing 16. A gap 18 is formed between the two barrels 12 and 14. The housing 16 houses a gearing system generally indicated at 20 which is operably driven by motor 22.

Figure 2:
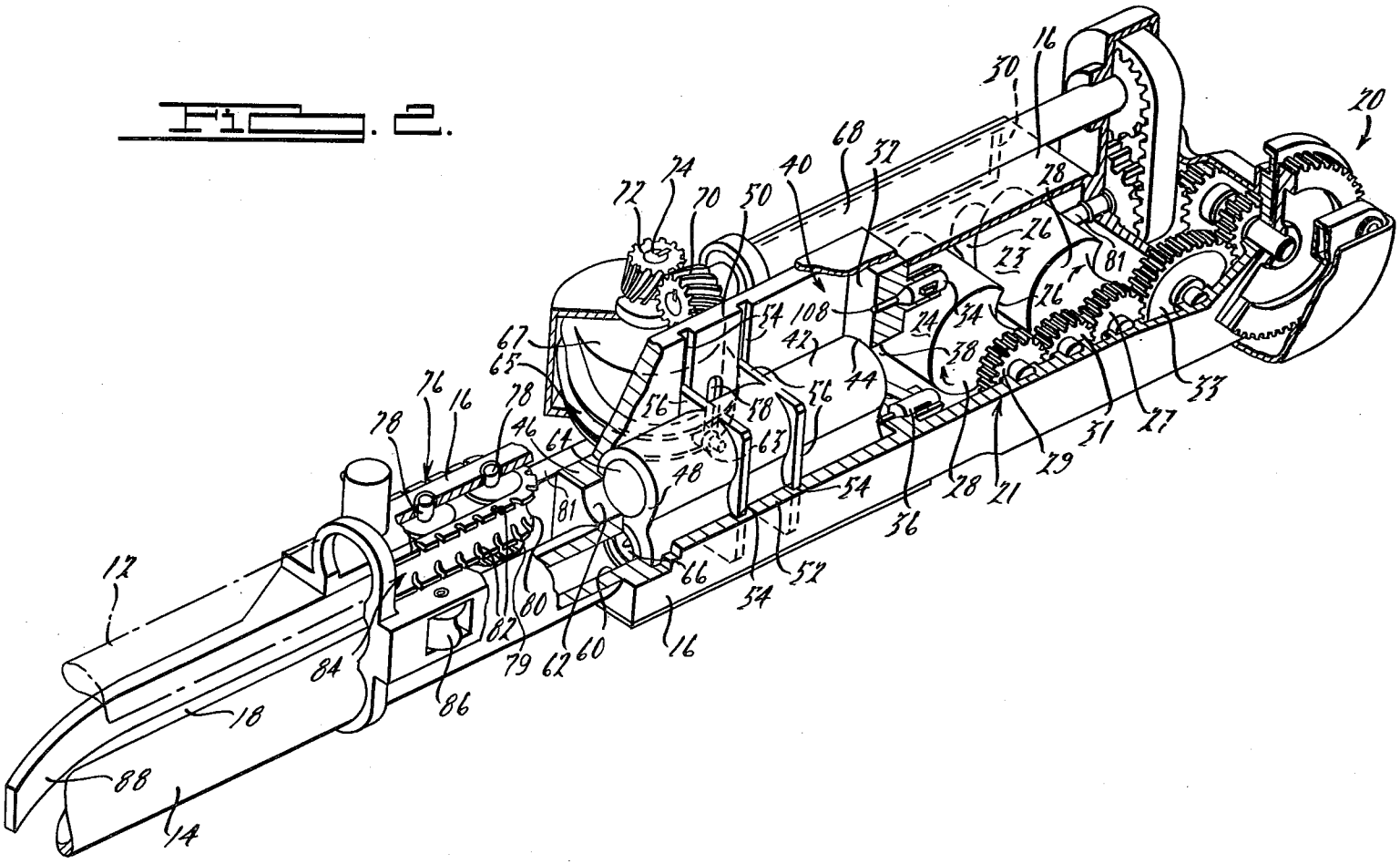
FIG. 2 is a partially broken and fragmentary view of the embodiment shown in FIG. 1.
Figure 7:
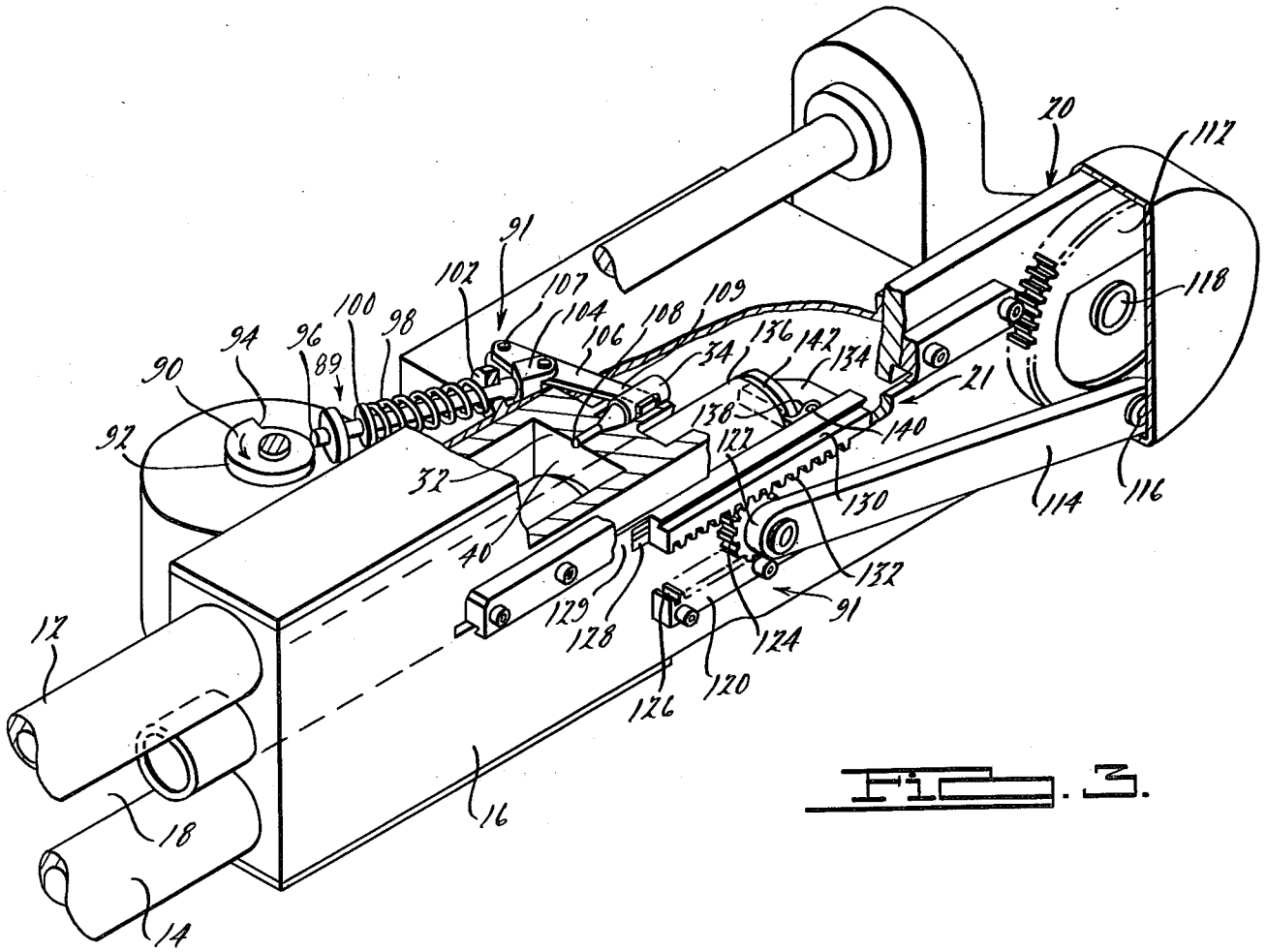

The gearing system 20, as more clearly shown in FIG. 2, is operably connected to a feed system generally indicated as 21. The feed system 21 includes a pair of augers 23 and 24 which are rotatably mounted about parallel axies which are transverse to the longitudinal axies of the barrels 12 and 14. Auger 23 has toothed gear 27 mounted thereon and auger 24 has toothed gear 29 coaxially mounted thereon. A pinion gear 31 is mounted between gears 27 and 29 and meshes therewith to cause both to rotate in the same direction. Gear 33 of gearing system 20 meshes with gear 27 to drive the augers 23 and 24. Each auger 23 and 24 has a helical groove 26 wrapped about its surface and axially ends with a zero pitch portion of the groove which forms a grooved ring 28 thereabout. Each auger 23 and 24 is positioned such that the upper portions of each helical groove 26 are longitudinally aligned to receive a round of ammunition thereon which enters from slot 30 in housing 16. Ammunition is delivered through slot 30 by conveyor belt (not shown) in a known manner.

The housing 16 has a vertical wall 32 which slideably mounts an upper firing pin 34 and a lower firing pin 36 therein. The wall 32 has an aperture 38 therethrough which is aligned in front of the upper portions of aligned grooved rings 28.

The wall 32 forms the rear portion of a vertically disposed compartment 40 which slideably houses a shuttle 42. The shuttle 42 is snugly received in compartment 40 such that the rear wall 32 abuts the rear end 44 of the shuttle and a front wall 46 of compartment 32 abuts the front end 48 of the shuttle 42. Side walls 50 and 52 of the compartment 40 have vertically extending grooves 54 therein which receive integral guide projections 56 extending from shuttle 42. Wall 50 also has a vertical extending slot 58 situated between the two grooves 54.

Figure 4:
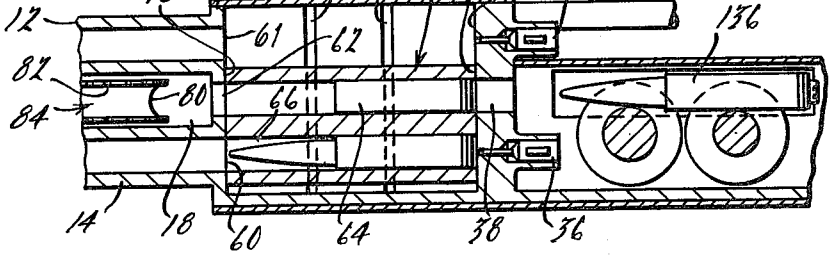
FIG. 4 is a side elevational cross-sectional and fragmentary view of the embodiment shown in FIG. 1.

Front wall 46 has an aperture 60 therethrough leading to lower barrel 14 and as shown in FIG. 4, aperture 61 leads to upper barrel 12. Between apertures 60 and 61, wall 46 has a central aperture 62 therethrough in communication with central gap 18. Aperture 62 is coaxially aligned with aperture 38.

The shuttle 42 has an upper bore 64 and a lower bore 66, which are parallel and vertically spaced apart extending from the rear end 44 to front end 48 of shuttle 42. The barrels 12 and 14, apertures 38 and 62, and bores 64 and 66 are spaced such that when the shuttle is in its lower position, as shown in FIGS. 2 and 4, the lower bore 66 is in communication with barrel 14 through aperture 60 and in communication with firing pin 36, and the upper bore 64 is aligned with apertures 38 and 62. When the shuttle is in an upper position; the bore 66 is in alignment with apertures 38 and 62, and the bore 64 is aligned with barrel 12 through aperture 58, and in communication with firing pin 34.

Referring back to FIG. 2, the shuttle has an integral lug 63 passing through slot 58 for driving the shuttle up and down between its two positions. The integral lug 63 is driven by a drive system which includes a circumferential groove 65 on drum 67 which is rotatably mounted about a vertical axis. Coaxially mounted to the drum 67 is a toothed gear 72 mounted onto pin 74. The toothed gear 72 meshes with a toothed gear 70 which is attached to a shaft 68 which is driven by the gearing system 20.

An endless conveyor belt 76 is mounted to housing 16 in front of aperture 62. The belt 76 is mounted about idle pulley 77 and drive pulley 78 which is operably linked in conventional fashion to gearing system 20 by means a gear 79 connected to one of the pulleys 78 and operably engageable to a complementary gear (not shown) mounted on a shaft 81 which connects to gearing system 20. The belt 76 is made from a suitable plastic material having a curved outer surface 80 with notches 82 spaced thereabout to aid in achieving the proper flexibility of the belt. The belt 76 is driven in a clockwise direction as shown in FIG. 2 such that its side 84 is driven forwardly away from aperture 62.

A series of roller bearings 86, as clearly shown in FIG. 1, is spaced apart from surface 84 such that a round of ammunition may extend between roller bearings 86 and belt surface 80 of side 84. A cam deflector 88 extends forwardly from belt 76 and bends to a side direction.

Referring to FIG. 3, the firing pin system 89 and raming mechanism portion 91 of feed system 21 will now be described. Each firing pin 34 and 36 is driven by a cam which is coaxially mounted onto drum 67. For simplicity only the upper cam 90 is shown with only the upper firing pin 34 since the upper and lower firing pin systems are identical. Cam 90 has an outer surface 92 which spirals outwardly with shoulder section 94 radially connecting the inner spiral end with the outer spiral end. The cam 90 as shown rotates in a counter clockwise direction and abuts a tappet 96 which is resiliently biased by spring 98 compressed between a collar 100 rigidly secured on tappet 96 and a flange 102 of housing 16. The tappet 96 has a knuckle end 104 pivotably mounted to firing pin lever 106 which is pivotably connected to housing 16 at one end 107 and to firing pin 34 at its other end 109. Firing pin 34 slideably extends through aperture 108 in wall 32. As the cam 90 rotates, the tappet 96 is biased to abut the surface 92 which, then rotated will withdraw the firing pin from compartment 40 and when shoulder 94 passes, tappet 96 will spring bias the firing pin 34 into the compartment 40 to abut a round of ammunition placed therein.

The ramming system 91 is driven by a toothed crank 112 which has a connecting rod 114 pivotably mounted about pivot pin 116 radially displaced from the center of rotation 118 of the crank 112. A toothed rack 120 is mounted on the side of housing 16. The connecting rod 114 has a pinion gear 124 at end 122. The gear 124 engages the teeth 126 on rack 120. Slidably mounted within slot 128 is a ram shaft 130 which also engages pinion gear 124 by means of its teeth 132. Ram shaft 130 has ram lug 134 which engages the rear end of round 136 of ammunition. A claw 138 is pivotably mounted about pin 140 and engages a groove 142 within the cartridge portion of round 136. A camming edge 129 engages the claw to disengage it from groove 142 when the shaft 130 completely pushes round 136 into one of the bores 64 or 66.

OPERATION

When the motor 22 is actuated, gear 33 of the gearing system 20 drives the toothed gears 27, 29, and 31 to rotate the augers 23 and 24 as shown in FIG. 2 in a clockwise direction. A conveyor system (not shown) delivers ammunition to slot 30 which the augers 23 and 24 can receive in their aligned grooves 26 one at a time. The augers 23 and 24, rotate and move the engaged aummunition round transversely across until the round is resting in the grooved rings 28. The augers 23 and 24 continuously move but the round of ammunition as shown in FIG. 4 obtains a dwell position due to the zero pitch of the rings 28. When a round of ammunition 136 is in its dwell position in rings 28, the continuously rotating crank wheel 112, as shown in FIG. 3, starts to drive the ram shaft 130 forward which accelerates the round through aperture 38 and into bore 64 as shown in FIG. 4.

Any spent cartridge within bore 64 is simultaneously pushed out through aperture 62 by the intrusion of round 136 until belt 80 which is rapidly driven in a forward axial direction frictionally grasps the spent cartridge and whips it out to deflection cam 88 which deflects any spent cartridge sideways away from the line of fire.

As the round 136 begins to be fully inserted in bore 64, the ram shaft 130 decelerates due to the sinusoidal motion rendered by crank 112. Claw 138 retains the round 136 so it does not accelerate ahead of push lug 134 so that round 136 is gently placed within bore 64. At this point, camming edge 129 releases the claw 138 from groove 132 and the crank 112 withdraws the shaft 130 passing the lug 134 over the now empty ring grooves 28.

Once round 136 is within bore 64, the shuttle is driven by continuously rotating drum 67 from its first dwell position upwardly in a linear fashion until bore 64 is then aligned with aperture 58. At this point the drum 67 creates a second dwell position at which the bore 64 is aligned with the barrel 12 and with its back end 44 flush against the wall 32 and the firing pin 34 directly behind the round 136. The bore 64 and rear wall 32 form a firing chamber for the round 136. At this point the cam 90 has shoulder 94 pass by tappet 96 so that the firing pin is spring biased against the round 136 through aperture 108 to set off the round 136. Upon firing of round 136, the cam 90 immediately starts to withdraw the firing pin 34 from the chamber 64.

Simultaneously, a second round is delivered onto the grooved ring position 28 to be rammed by the ram shaft 130 into bore 66 which is now aligned with aperture 38. Any spent cartridge within bore 66 is then ejected, in the same fashion as a spent cartridge in bore 64, out through aperture 62 and accelerated by acceleration belt 76. As the second round is positioned within bore 66 and the projectile is fired from bore 64, the shuttle then is driven by drum cam 67 back to its first dwell position wherein bore 66 is aligned with barrel 14 and firing pin 36 directly behind the new incoming round in bore 66. Bore 66 and wall 32 form a firing chamber for the second round. Bore 64 is realigned with aperture 38 and 62. At this point the firing pin 36 is operated to set off the new incoming round in bore 66 and the spent cartridge in 64 is then ejected in the same fashion by a third round being driven by ram shaft 130.

In this fashion, the shuttle is linearly driven between two positions and forms firing chambers for two fixed barrels. The feed system feeds both bores in the shuttle. Two continuously moving augers and a continuously moving drum allows for a simpler and lighter design due to the elimination of stop-go motion which creates higher stress loads. The needed dwell positions are accommodated by the sinusoidal motion of the crank 112 and the zero pitch of the ring grooves in the augers and the shape of the groove in the drum.

The acceleration belt insures that during start-up that any spent cartridge is quickly and fully withdrawn from the bores in the shuttle so that any risk of jamming is kept to a minimum.

In this fashion, a lightweight compact externally powered machine gun is designed with a minimum amount of motion and with capabilities of shooting over three thousand rounds per minute.

Variations and modifications are possible within the spirit and scope of the invention as defined by the appended claims.

The embodiments of the invention in which an exclusive property or privilege is claimed are defined as follows:

1. A loading and ejection system for a machine gun comprising;

a housing;

a motor means mounted onto said housing for powering said gun;

a gearing means mounted onto said housing and operably connected to said motor means for driving various operations of said gun in predetermined phased relationships;

feed means operably connected to the gearing means for supplying ammunition to said machine gun;

two parallel barrels fixedly mounted on said housing spaced apart at least a diameter of a round of said ammunition;

a shuttle having two parallel and spaced bores therethrough forming the bores of two firing chambers;

the housing having a planar wall axially spaced behind said barrels and shuttle and abutting the rear end of said shuttle to form the rear wall of the formed firing chambers;

a drive means operably connected to said gearing means for linearly and reciprocally moving the shuttle between a first position in which one bore is in alignment with said feed means and a second bore is in alignment with one of said barrels and a second position in which said second bore is in alignment with said feed means and said first bore in alignment with the other of said barrels;

said shuttle being in abutment with the rear end of said barrels to provide a continuous passage from an aligned bore of said shuttle to said aligned barrel for passage of a projectile portion of said round.

2. A loading and ejection system for a machine gun as defined in claim 1 wherein;

said drive means comprises a cylindrical drum operably connected to said gearing means for rotation about a central axis;

said drum having a cylindrical side with an endless camming groove thereabout with axially varying positions about said cylindrical side;

said shuttle having a lug ridigly fixed thereto operably engaged with said camming groove for following the axial position of said groove about said drum when rotated for linear and reciprocal movement between said two positions.

3. A loading and ejection system for a machine gun as defined in claim 2 further comprising:

two firing pin cams coaxially mounted with said drum with means operably connecting said cam to two firing pins such that movement of said cams intrudes said firing pins into one of said bores in alignment with one of said at least one barrel for firing a contained round therein, said connecting means constructed to withdraw each firing pin from said bore when said bore of said shuttle linearly moves toward said feed means.

4. A loading and ejection system for a machine gun as defined in claim 1 or 3 wherein:

said feed means comprises a pair of augers rotatably mounted about parallel axes;

each auger having a helical groove therein with an end of each groove forming a zero degree pitched grooved ring about said auger;

said augers operably connected to said gearing means for continuous and simultaneous, rotation such that the position of said helical grooves on said pair of augers are longitudinally aligned to receive a round of ammunition;

said ring portions of said grooves being aligned with each other and aligned with said bores in said shuttle when said bores are in their aligned position with the feed means;

ramming means for sliding said round of ammunition from a dwell position in said ring portion of said grooves of said auger through a rear open end in said shuttle and into said bore in said aligned position with said feed means.

5. A loading and ejection system for a machine gun as defined in claim 4 wherein;

said ramming means comprises;

a toothed rack mounted on said housing;

a pinion gear engaging said toothed rack, a connecting rod having one end pivotably connected to said pinion gear;

a crank operably connected to said gearing means and pivotably connected to an opposing end of said connecting rod;

a ram shaft slideably mounted to said housing and operably connected to said pinion gear for reciprocating linear motion with decelerated motion at its two end positions.

said ram shaft engaging one round of ammunition when in a withdrawn position and moveable to a second forward position which rams said round into said bore of said shuttle;

a claw means for engaging a groove in said round and mounted to said ram shaft such that upon the decelerated motion of said ram shaft due to the mechanical linkage of said ram shaft to said crank, said round is retained by said claw from excessive forward motion as said round is rammed into said bore;

a cam mounted to said housing positioned to disengage said claw means from said round when said round reaches a dwell position in said shuttle and before said ram shaft commences motion back to its withdrawn position.

6. A loading and ejection system for a machine gun as defined in claim 4 wherein;

said housing has an aperture aligned with said bore of said shuttle when said bore is in its aligned position with the feed means and axially spaced in front of said bore such that upon ramming of one round into said bore from said open rear end thereof, a cartridge therein will be ejected out through said aperture into said space between said barrels by said incoming round.

7. A loading and ejection system for a machine gun as defined in claim 6 wherein a belt is connected to said housing and positioned to be axially aligned with said aperture;

said belt operably connected to said motor means for movement in an axial direction away from said aperture such that upon starting of said gun, said belt frictionally grasps any ejecting cartridges from said aperture and axially accelerates them forwardly to ensure said cartridge is completely withdrawn from said bore of said shuttle before said shuttle linearly moves to its other position.

8. A loading and ejection system for a machine gun comprising;

a housing;

a motor means mounted onto said housing for powering said gun;

gearing means mounted onto said housing and operably connected to said motor means for driving various operations of said gun in predetermined phases relationship;

feed means operably connected to said gearing means for supplying ammunition to said gun;

two parallel barrels fixedly mounted to said housing;

a firing chamber alignable with each barrel;

an ejection hole in said housing for ejecting spent cartridges from said feed means in a forward direction;

a belt mounted on said housing and operably connected to said motor means for movement in a forward axial direction away from said ejection hold such that upon starting of said gear, said belt frictionally grasps any ejecting cartridges from said ejection hole and axially accelerates them to ensure said cartridge is completely withdrawn from said ejection hole before said feed means moves to another position.

9. A loading and ejection system for a machine gun as defined in claim 8 wherein;

said belt is an endless looped belt for rotation about pulleys pivotably mounted on said housing;

said motor means operably connected to at least one pulley for driving said belt such that the belt surface facing the edge of said ejection hole moves away therefrom in a forward axial direction.

10. A loading and ejection system for a machine gun comprising:

a housing;

a motor means mounted onto said housing for powering said gun;

gearing means mounted onto said housing and operably connected to said motor means;

at least one barrel mounted onto said housing;

at least one movable firing chamber movable between a position aligned with said at least one barrel and a second position;

a feed means operably connected to the gearing means for supplying ammunition to said firing chamber when said firing chamber is in its second position;

drive means for moving said firing chambers between said two positions thereof;

said feed means including a pair of augers rotatably mounted about parallel axes;

each auger having a helical groove therein with the end of both grooves forming aligned zero pitched grooved rings on said augers;

said augers operably connected to said gearing means for continuous and simultaneous rotation such that portions of said helical grooves are longitudinally aligned to receive a round of ammunition;

said grooved ring poritions of said grooves being longitudinally aligned with each other for receiving a round of ammunition and maintaining said round in a dwell position therein as said augers rotate;

ramming means for sliding said round of ammunition in said dwell position in said grooved rings axially forward into said aligned firing chamber.

11. A loading and ejection system for a machine gun as defined in claim 8 or 10 wherein:

said firing chamber is a bore in a shuttle;

said shuttle being linearly moveable between two positions wherein in one position said firing chamber is in alignment with said feed means, and a second position wherein said firing chamber is in alignment with a barrel; and a drive means linearly and reciprocally moves said shuttle between its two positions.

* * * * *

UNITED STATES PATENT AND TRADEMARK OFFICE

CERTIFICATE OF CORRECTION

PATENT NO. : 4,309,933

DATED : January 12, 1982

INVENTOR(S) : William R. Bains

It is certified that error appears in the above-identified patent and that said Letters Patent are hereby corrected as shown below:

On the title page where it reads "Assignee", please cancel "Ford Motor Company, Dearborn," and insert therefor -- Ford Aerospace and Communications Corporation, Detroit, --.

In the Abstract, at the end of the first line, please delete [which].

Column 1, line 30, "Wasset" should read -- Wassel --.

Column 1, line 66, "may" should read -- any --.

Column 2, lines 37 and 38, "axies" should read -- axes --.

Column 4, lines 53-54, "ring grooves" should read -- grooved rings --.

Claim 2, line 15, "ridigly" should read -- rigidly --.

Claim 10, line 39, "poritions" should read -- portions --.

Signed and Sealed this

*Fourteenth* Day of *September 1982*

[SEAL]

*Attest:*

GERALD J. MOSSINGHOFF

*Attesting Officer*

*Commissioner of Patents and Trademarks*